United States Patent [19]

Segerljung

[11] Patent Number: 4,782,869

[45] Date of Patent: Nov. 8, 1988

[54] DEVICE FOR MECHANICALLY SPLITTING CLEAVABLE OBJECTS

[75] Inventor: Max Segerljung, Vännäs, Sweden

[73] Assignee: Maxwheel AB, Vannas, Sweden

[21] Appl. No.: 10,193

[22] PCT Filed: Mar. 25, 1986

[86] PCT No.: PCT/SE86/00134

§ 371 Date: Dec. 23, 1986

§ 102(e) Date: Dec. 23, 1986

[87] PCT Pub. No.: WO86/05736

PCT Pub. Date: Oct. 9, 1986

[30] Foreign Application Priority Data

Mar. 27, 1985 [SE] Sweden ..... 8501512

[51] Int. Cl.[4] ..... B27L 7/00

[52] U.S. Cl. ..... 144/193 R; 144/366; 144/240; 225/93

[58] Field of Search ..... 83/4; 144/193 R, 363, 144/366, 369, 376, 377, 378, 240

[56] References Cited

U.S. PATENT DOCUMENTS 1,328,471 1/1920 Young ..... 144/193 R
1,691,102 11/1928 Witham, Sr. ..... 144/193 R

FOREIGN PATENT DOCUMENTS

WO84/03655 9/1984 PCT Int'l Appl. .
192889 12/1937 Switzerland .

*Primary Examiner*—W. Donald Bray
*Attorney, Agent, or Firm*—Cushman, Darby & Cushman

[57] ABSTRACT

A device for mechanically splitting cleavable objects, especially blocks of wood, comprising two rotatable splitting wheels (2) whose rotation is effected by a motor (9). The splitting wheels (2) are provided with a number of teeth (40) and rotate in the directions A and B, respectively. Blocks of wood intended for splitting are fed in their longitudinal direction, direction C, in a guide chute (20), a centering device providing centering of the blocks relative to the splitting wheels (2). The splitting wheels (2) interact to effect cleaving of the wooden blocks and throw them divided into two parts through the outlet opening (22) of the guide chute (20).

8 Claims, 2 Drawing Sheets

DEVICE FOR MECHANICALLY SPLITTING CLEAVABLE OBJECTS

BACKGROUND OF THE INVENTION

This invention relates to a device for mechanically splitting cleavable objects, especially blocks of wood.

Two main types of splitting machines for mechanical cleavage of wooden blocks are today found on the market. One of said types has a fixedly mounted splitting knife against which the block of wood is pressed by a means exerting a force so that the splitting knife will cleave the block. The other machine type operates so that a conical means provided with a male thread is screwed mechanically into the block, said means splitting the block at screwing and effecting the desired cleavage thereof in this way.

SUMMARY OF THE INVENTION

It is the object of the invention to provide a device for mechanical cleavage of wood enabling a higher cleaving capacity than what is usually normal, simultaneously as the construction of the device is relatively simple, and this object is achieved in that the device has been given the characteristic features defined in the claims.

One advantage of the invention in comparison with previously known solutions is that the invention offers a device for mechanical cleavage of pieces of wood, etc, the cleaving capacity of which is very high and the required power of which is low. Moreover, the construction of the device of the invention is very simple.

BRIEF DESCRIPTION OF THE DRAWINGS

Illustrative examples of the invention will be described in greater detail below with reference to the enclosed drawings, in which.

DETAILED DESCRIPTION

Figure 1:
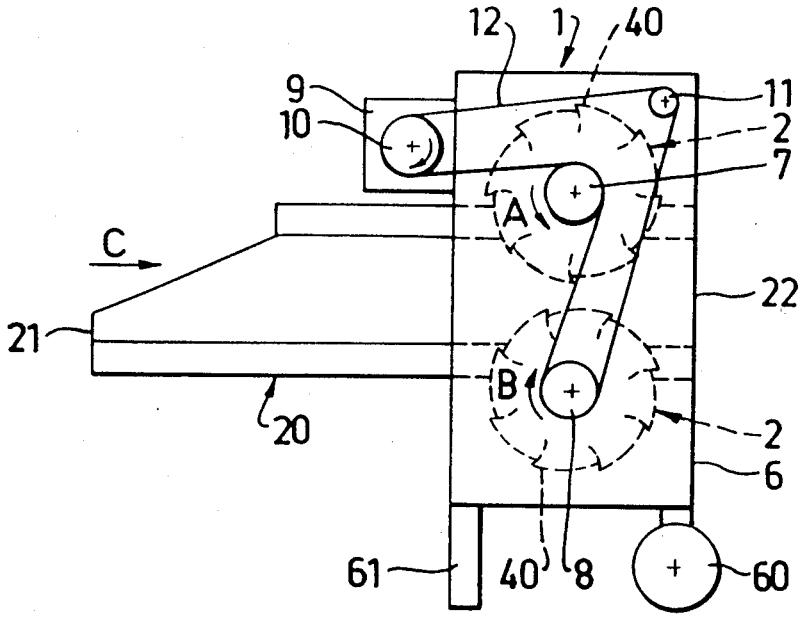
FIG. 1 is a schematic lateral view of a mechanical wood splitting device according to the invention.

The mechanical wood splitting device 1 comprises two splitting means in the form of splitting wheels 2 which are fixedly connected to axles 3 and 4 supporting the splitting wheels. The axles 3 and 4 are supported by the frame 6 of the wood splitting device 1 via bearings 5. The axles 3 and 4 support at one of their ends pulleys 7 and 8. Furthermore, the wood splitting device is provided with a drive means in the form of e.g., an electric motor 9 which supports a pulley 10 on its drive shaft. The frame 6 also supports a stretch roll which is arranged to be movable and by means of which the tension of a drive belt 12 can be adjusted. How the drive belt 12 is drawn is apparent from FIG. 1 and the motor 9 drives the splitting wheels 2 in the directions shown by the arrows A and B.

Figure 2:
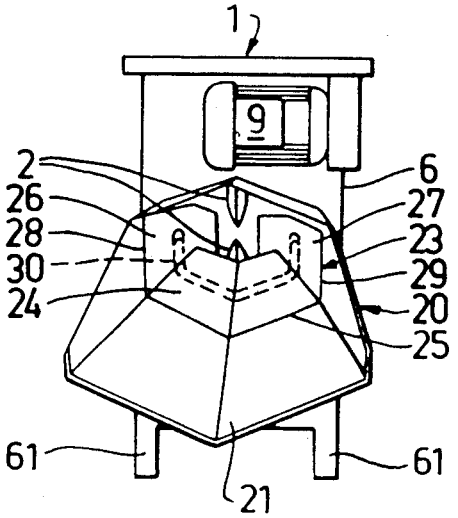
FIG. 2 is a perspective view of the device as seen from its inlet side.
Figure 3:
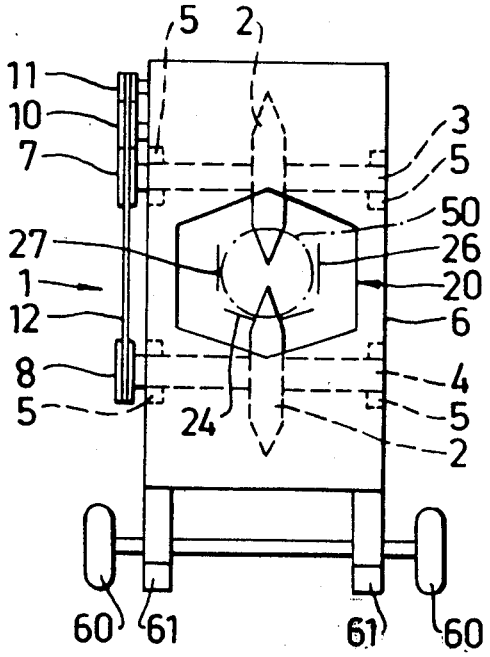
FIG. 3 is a schematic view of the device as seen from its outlet side.

The wood splitting device 1 comprises further a guide chute 20 extending through the whole device 1 and having recesses for the splitting wheels 2. The guide chute 20 has an inlet 21 and an outlet 22. In the guide chute 20 between the inlet 21 and the splitting wheels 2 there is arranged a centering device 23. The centering device 23 comprises a V-shaped bottom plate 24 which is articulatedly connected to the guide chute 20 at its end 25 located immediately at the inlet 21 of the guide chute 20. Moreover, the centering device 23 comprises two side plates 26 and 27 which are also articulatedly connected to the guide chute 20 at their ends 28 and 29, respectively, facing the inlet 21 of the guide chute 20. A resilient means in the form of e.g., a rubber band 30 holds in its inactivated state the bottom plate 24 and the side plates 26, 27 against each other, as shown in FIG. 2. At its ends the rubber band 30 is connected with the side plates 26 and 27, bears upon the underside of the bottom plate 24 and lifts this.

Figure 4:
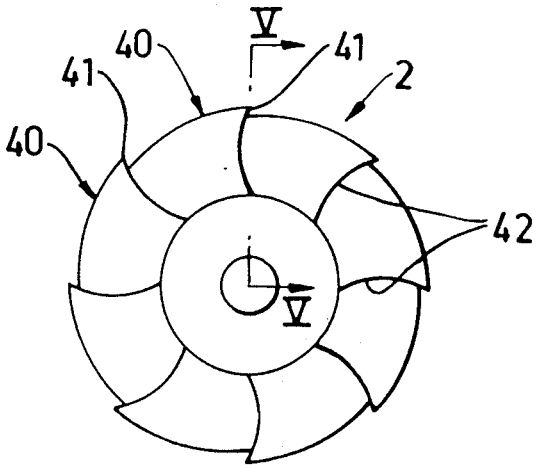
FIG. 4 is a lateral view on a larger scale of a splitting device according to the invention and FIG. 5 is a section of the splitting device taken along the line V—V in FIG. 4.
Figure 5:
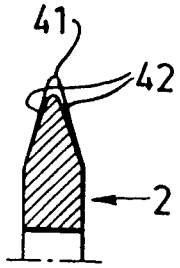

The design of the splitting wheels 2 is best apparent from FIGS. 4 and 5. In the illustrative example shown the splitting wheels 2 have eight teeth 40 with a tooth point 41. There are transitional edges 42 between the teeth 40 on the side surfaces of the splitting wheels 2.

The mechanical wood splitting device 1 of the invention operates as follows. The wooden blocks to be split are fed in their longitudinal direction in the guide chute 30 from its inlet side 21. According as new wooden blocks are supplied the block in front is displaced ever more into the chute 20 in the direction C. When a wooden block 50 enters the centering device 23 it actuates the latter so that the side plates 26 and 27 are removed from each other in dependence on the size of the wooden block 50 and so that the bottom plate 24 moves downwards in dependence on the weight of the wooden block. A well functioning centering of each wood block 50 can be achieved in this way by using a resilient means 30 suitable for the purpose. When a wooden block 50 thus centered during its feeding reaches the constantly rotating splitting wheels 2 these provide the continued feeding of the current wooden block. Simultaneously the wooden block is divided into two parts by the splitting wheels at its passage past these and the split block parts are also thrown out of the wood splitting device 1 through its outlet 22 by the splitting wheels.

The transitional edges 42 of the splitting wheels 2 aid in throwing out split blocks. As the split wooden blocks are thrown one meter or two from the block splitting device the need of a following conveyor for transporting away the split block from the vicinity of the wood splitting device is mostly eliminated. Moreover, it can be mentioned that the mechanical block splitting device 1 is easily movable as it is provided with two wheels 60 and two legs 61.

If the splitting means 2 are designed so that they have a great mass-moment of inertia and are rotated at a high angular speed a very high splitting capacity of the wood splitting device is made possible.

It should be realized that the rotational drive of the splitting means 2 can be achieved within the scope of the invention in a plurality of different ways in addition to that shown in the illustrative example. It is e.g. possible to make oneself independent of current supply by choosing, e.g., one or two combustion engines instead of an electric motor. As to the rotational drive of the splitting wheels there is also a possibility of providing only one thereof with a drive and have the other splitting wheel rotating freely.

As to the form of the splitting means 2 a series of alternative embodiments are possible in addition to the form provided with teeth. However, the outer form of the splitting wheel should preferably deviate from a quite circular one and the outer form of the wheels can, e.g., be like a polygon or square. The form and side of the two splitting means need not necessarily be mutually similar, either.

A device according to the invention can be made extremely safe in respect of accident prevention as feeding of wooden blocks to the splitting means 2 due to the length and form of the guide chute 20 must be carried out so that the current wooden block to be cleft is fed by pushing it by means of a following wood block. Otherwise there are good possibilities of safely encapsulating the splitting means as well as the transmission for the drive of the splitting means. The outlet 22 of the guide chute 20 can be covered, e.g., by a resilient rubber plate.

Thus, the invention is not limited to what has been shown and described but amendments and modifications are possible within the scope of the following claims.

I claim:

1. A device for mechanically splitting cleavable objects, especially blocks of wood, comprising:

a frame;

a pair of rotatable splitting wheels mounted on respective axles which are journalled for rotation on the frame so that said splitting wheels have respective axes of rotation arranged in a common plane and have respective outer peripheral surfaces which spacedly confront one another at a cleavable object-receiving nip between the splitting wheels;

drive means operatively connected to at least one of said splitting wheels for power-rotating at least one of said splitting wheels about the respective said axis;

said splitting wheels each having two axially opposite side faces rimmed by the respective said outer peripheral surface;

at least one of said splitting wheels having a plurality of angularly-spaced teeth provided on and projecting outwardly from said outer peripheral surface thereof; and each said splitting wheel which is provided with said teeth having a plurality of angularly spaced, generally radially extending tooth edges provided on each said opposite side face thereof, each said tooth edge having a shoulder which faces angularly of the respective splitting wheel.

2. The device of claim 1, wherein:

at least some of said tooth edges provided on said side faces extend from respective ones of said teeth as continuations thereof.

3. The device of claim 2, wherein:

said drive means is operatively connected to both of said splitting wheels for power counter-rotating said splitting wheels about the respective said axes; and both of said splitting wheels are provided with said teeth.

4. The device of claim 3, wherein:

at least some of said tooth edges are arranged as pairs of correspondingly-located tooth edges on respective of said opposite sides of said splitting wheels; and the two tooth edges in each said pair obliquely diverge axially away from the respective said tooth radially towards the respective said axle.

5. The device of claim 1, further including:

a guide chute mounted to said frame and arranged to converge towards said nip on an upstream side of said nip, for feeding and centering a succession of cleavable objects along a path into said nip for cleavage by said splitting wheels.

6. The device of claim 3, further including:

a guide chute mounted to said frame and arranged to converge towards said nip on an upstream side of said nip, for feeding and centering a succession of cleavable objects along a path into said nip for cleavage by said splitting wheels.

7. The device of claim 4, further including:

a guide chute mounted to said frame and arranged to converge towards said nip on an upstream side of said nip, for feeding and centering a succession of cleavable objects along a path into said nip for cleavage by said splitting wheels.

8. The device of claim 1, wherein:

the guide chute includes a fixed outer portion merging at a downstream end thereof with an inner portion which forms a continuation thereof, said inner portion comprising a plurality of movable walls arranged to surround said path;

said movable walls being mounted for articulated movement towards and away from said path; and a resilient means engaging at least some of said movable walls for resiliently urging said movable walls towards maintaining a convergent condition, said movable walls being temporarily urgeable laterally outwards from said path, against said resilient means, by action of cleavable objects passing through said inner portion of said guide chute into said nip, whereby said inner portion of said guide chute centers cleavable objects into said nip for splitting between said splitting wheels

* * * * *